US012391886B2

(12) United States Patent
Zheng et al.

(10) Patent No.: US 12,391,886 B2
(45) Date of Patent: Aug. 19, 2025

(54) ULTRASONIC OXIDATIVE DESULFURIZATION METHOD FOR GASOLINE OR DIESEL

(71) Applicant: PurePath (Chongqing) Petroleum Engineering Co., LTD., Chongqing (CN)

(72) Inventors: Qiwei Zheng, Chongqing (CN); Ruipeng Chen, Chongqing (CN)

(73) Assignee: PurePath (Chongqing) Petroleum Engineering Co., LTD., Chongqing (CN)

( * ) Notice: Subject to any disclaimer, the term of this patent is extended or adjusted under 35 U.S.C. 154(b) by 145 days.

(21) Appl. No.: 18/235,913

(22) Filed: Aug. 21, 2023

(65) Prior Publication Data

US 2024/0425766 A1 Dec. 26, 2024

(51) Int. Cl.
*C10G 27/12* (2006.01)
*C10G 21/28* (2006.01)

(52) U.S. Cl.
CPC ..... *C10G 27/12* (2013.01); *C10G 21/28* (2013.01); *C10G 2300/104* (2013.01);
(Continued)

(58) Field of Classification Search
CPC ..... C10G 27/12; C10G 27/04; C10G 53/14; C10G 2300/202; C10G 67/12;
(Continued)

(56) References Cited

U.S. PATENT DOCUMENTS

2004/0074812 A1* 4/2004 Cullen ..... C10G 45/58 208/240
2012/0055845 A1* 3/2012 Bourane ..... C10B 55/00 208/90
2015/0075063 A1* 3/2015 Chan ..... C10G 27/12 44/436

FOREIGN PATENT DOCUMENTS

CN 1814710 A 8/2006
CN 1861758 A 11/2006
(Continued)

OTHER PUBLICATIONS

"Petroleum products Determination of sulfur content-Wavelength dispersive X-ray fluorescence spectrometric method"; National Tomb Standards of the People's Republic of China; Aug. 25, 2008; 53 Pgs.
(Continued)

*Primary Examiner* — Prem C Singh
*Assistant Examiner* — Juan C Valencia
(74) *Attorney, Agent, or Firm* — Cooper Legal Group, LLC

(57) ABSTRACT

The present application refers to an ultrasonic oxidative desulfurization method for gasoline or diesel, comprising: Step 1, mixing an oxidant solution with an organic acid catalyst solution to obtain a mixture solution, wherein the oxidant reacts with the organic acid catalyst to obtain a peroxy acid; Step 2, mixing the mixture solution with gasoline or diesel and heating to 50 to 70° C., and performing an ultrasonic oxidative reaction under ultrasonic waves at 15 to 25 kHz to obtain a pre-prepared oil; wherein a mass flow ratio of the oxidant solution, the organic acid catalyst solution and the gasoline or diesel is (0.03-0.08):(0.01-0.03):1; Step 3, performing a phase separation process to the pre-prepared oil; and Step 4, recycling the organic acid catalyst and performing a countercurrent extraction for the gasoline or diesel to obtain a desulfurized gasoline or diesel.

5 Claims, 1 Drawing Sheet

(52) U.S. Cl.
CPC ..... *C10G 2300/1055* (2013.01); *C10G 2300/202* (2013.01); *C10G 2300/706* (2013.01)

(58) Field of Classification Search
CPC .... C10G 53/04; C10G 2400/04; C10G 27/00; C10G 45/02; C10G 21/28; C10G 2300/104; C10G 2300/1055; C10G 2300/706; C10G 21/20; C10G 2300/44; C10G 2300/1044; C10G 2300/1059; C10G 2400/02
See application file for complete search history.

(56) References Cited

FOREIGN PATENT DOCUMENTS

| | | | |
|---|---|---|---|
| CN | 101921609 | A | 12/2010 |
| CN | 101921613 | A | 12/2010 |

OTHER PUBLICATIONS

Sun, Ming-zhu, et al., "Study on the Comparison of Oxidative Desulfurization of Diesel Fuel under the Condition of Ultrasound and Non-ultrasound", Chemistry and Adhesion, 2009, 31(6): 26-29, with English abstract.
Office Action received in corresponding Chinese patent application No. 202310762485.7, dated Oct. 24, 2024, 14 pages.

* cited by examiner

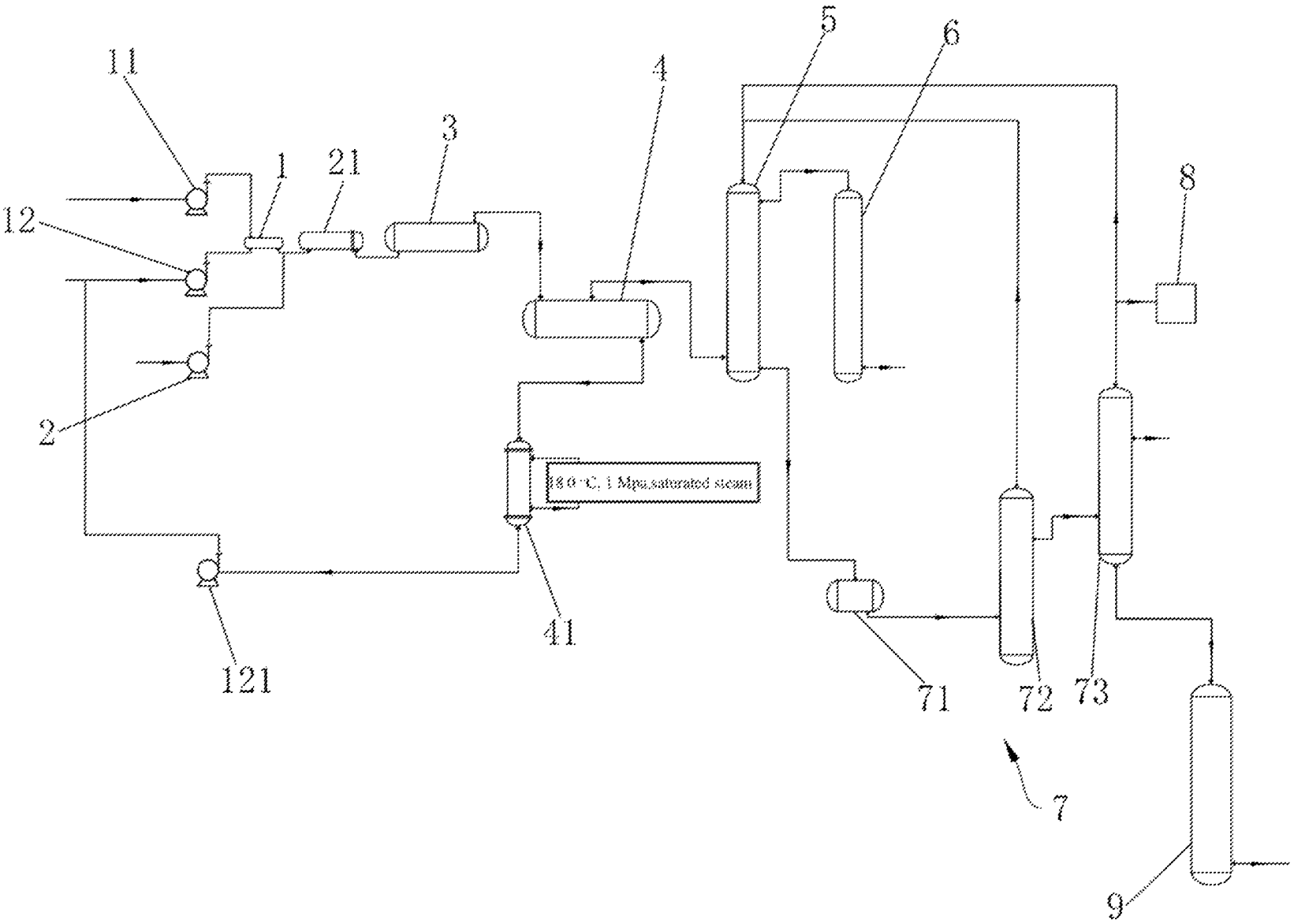
8
9
73
72
7
6
71
5
4
41
3
21
1
121
11
12
2

ULTRASONIC OXIDATIVE DESULFURIZATION METHOD FOR GASOLINE OR DIESEL

CROSS-REFERENCE TO RELATED APPLICATION

This application is based on and claims the priority and benefit of Chinese patent application serial no. 202310762485.7, filed on Jun. 26, 2023. The entirety of Chinese patent application serial no. 202310762485.7 is hereby incorporated by reference herein and made a part of this specification.

TECHNICAL FIELD

The present application relates to the field of desulfurization technology for gasoline or diesel, and in particular to an ultrasonic oxidative desulfurization method for gasoline or diesel.

BACKGROUND ART

Diesel and gasoline usually contain a certain amount of sulfur compounds, the sulfur compounds easily causes corrosion of metal equipment in the fuel machinery; and the combustion of diesel and gasoline generates $SO_x$, which leads to the formation of acid rain and pollution of the environment. The sulfur compounds in diesel and gasoline are mainly thiophenic sulfur, and the current desulfurization methods for diesel and gasoline mainly include oxidative desulfurization, biological desulfurization and extractive desulfurization, etc. Specifically, the oxidative desulfurization technology is widely used due to its advantages of not using hydrogen source, low costs in investment and operation, and mild reaction conditions.

In the oxidative desulfurization process, oxidant and organic acid is mixed to react and generate peroxy acid, then the peroxy acid reacts in diesel or gasoline to produce a pre-prepared oil containing sulfoxide or sulfone, the pre-prepared oil is conveyed into the extraction tower to extract the sulfoxide or sulfone for the purpose of desulfurization of diesel and gasoline. Moreover, in order to enhance the effect of oxidative desulfurization, the oxidative desulfurization process is usually performed in an ultrasonic reactor to increase the oxidation rate and the effect of oxidative desulfurization.

In the process of industrial desulfurization of diesel and gasoline, diesel or gasoline needs to be conveyed into the ultrasonic reactor at a certain flow rate continuously for oxidative desulfurization. When the ratio of the flow rate of the oxidant and organic acid catalyst to the flow rate of diesel or gasoline in the ultrasonic reactor is small, the oxidative desulfurization effect of diesel and gasoline will be poor; when the ratio of the flow rate of the oxidant and organic acid catalyst to the flow rate of diesel or gasoline in the ultrasonic reactor is large, it is difficult for all of the peroxy acid generated by the reaction of the oxidant and the organic acid catalyst to react with the sulfur compounds in diesel or gasoline, for generating thiophenic sulfur, which leads to excess peroxy acid, and a waste of the oxidant, and increases the difficulty for recycling the organic acid catalyst as well.

SUMMARY

In order to enhance the effect of oxidative desulfurization and reduce the waste of the oxidant and the difficulty for recycling the organic acid catalyst, the present application provides an ultrasonic oxidative desulfurization method for gasoline or diesel, and a desulfurization system.

The present application provides an ultrasonic oxidative desulfurization method for gasoline or diesel, and a desulfurization system adopting the following technical solutions:

an ultrasonic oxidative desulfurization method for gasoline or diesel, including:

Step 1, mixing an oxidant solution with an organic acid catalyst solution to obtain a mixture solution, wherein the oxidant reacts with the organic acid catalyst to obtain a peroxy acid;

Step 2, mixing the mixture solution with gasoline or diesel and heating to 50 to 70° C., and performing an ultrasonic oxidative reaction under ultrasonic waves at 15 to 25 kHz to obtain a pre-prepared oil; wherein a mass flow ratio of the oxidant solution, the organic acid catalyst solution and the gasoline or diesel is (0.03-0.08):(0.01-0.03):1;

Step 3, performing a phase separation process to the pre-prepared oil, wherein an upper layer is gasoline or diesel containing sulfone and sulfoxide, and a lower layer is an aqueous phase containing the organic acid catalyst; and Step 4, recycling the organic acid catalyst and performing a countercurrent extraction for the gasoline or diesel to obtain a desulfurized gasoline or diesel.

In the above technical solutions, in the process of industrial desulfurization of gasoline or diesel, the oxidant solution with a flow rate of 3 to 8% of the flow rate of gasoline or diesel and the organic acid catalyst solution with a flow rate of 1 to 3% of the flow rate of gasoline or diesel are conveyed respectively, so that the conveyed oxidant and organic acid catalyst can be mixed and react constantly, and a relatively appropriate amount of peroxy acid is generated, so as the appropriate amount of peroxy acid performs an oxidation reaction in the conveyed gasoline or diesel continuously. The thiophenic sulfur contained in the gasoline or diesel can be oxidized by the relatively appropriate amount of peroxy acid as completely as possible, to generate sulfone or sulfoxide, so that a lower sulfur content in the gasoline or diesel can be achieved as compared to the sulfur content of current desulfurization technologies, and the effect of the oxidative desulfurization of gasoline or diesel can be improved. Meanwhile, the relatively appropriate amount of peroxy acid can react with the thiophenic sulfur in the gasoline or diesel as completely as possible, so that the peroxy acid can be reduced as completely as possible to generate the organic acid catalyst, such that the amount of peroxy acid after the ultrasonic oxidation is as little as possible. The remaining amount of the peroxy acid after the ultrasonic oxidation is minimized, so as to reduce the waste of the oxidant and the difficulty for recycling the organic acid catalyst while improving the effect of oxidative desulfurization.

In some embodiments, a method for recycling the organic acid catalyst includes:

drying and dehydrating the aqueous phase containing the organic acid catalyst by a desiccant, and formulating the dehydrated organic acid catalyst into a solution and conveying the solution into the mixture solution in Step 1.

In the above technical solutions, the aqueous phase containing the organic acid catalyst is dried and dehydrated by the desiccant to generate the dehydrated organic acid catalyst. The dehydrated organic acid catalyst is re-formulated into an organic acid catalyst solution, the formulated organic acid catalyst solution is conveyed into the mixture solution where the peroxy acid is generated, and the organic acid catalyst can react with the oxidant to generate the peroxy acid again to achieve the recycling of the organic acid catalyst, which saves costs and enhances environmental protection.

In some embodiments, the desiccant is passed through a saturated steam at 170 to 190° C. and 0.5 to 2 MPa, and the desiccant is heated to 150 to 170° C. for the drying and dehydrating, and a dehydrated desiccant is conveyed into the aqueous phase containing the organic acid catalyst.

In the above technical solutions, after the aqueous phase containing the organic acid catalyst is dried and dehydrated by the desiccant, the desiccant will saturate with water. Then the desiccant is dried and dehydrated, the dehydrated desiccant is re-conveyed into the aqueous phase containing the organic acid catalyst, and plays a drying role on the organic acid catalyst again, so that the recycling of the desiccant is achieved, which further saves costs and enhances environmental protection.

In some embodiments, the ultrasonic oxidative desulfurization method for gasoline or diesel further includes a post-treatment step for the desulfurized gasoline or diesel:

performing a desolvent treatment for the desulfurized gasoline or diesel at a condition of 90 to 110° C. and 0.5 to 1.5 kPa, to obtain a desolvated and desulfurized gasoline or diesel.

In the above technical solutions, a countercurrent extraction is performed for the gasoline or diesel containing sulfone and sulfoxide to obtain desulfurized gasoline or diesel containing a small amount of solvent, and the small amount of solvent in the desulfurized gasoline or diesel is removed by reduced pressure distillation at 90 to 110° C. and 0.5 to 1.5 kPaA to obtain desolvated desulfurized gasoline or diesel, which improves the quality of the oil product.

In some embodiments, the ultrasonic oxidative desulfurization method for gasoline or diesel further includes a step of recycling an extractant from a sulfone-containing waste solvent generated from the countercurrent extraction.

In the above technical solutions, the extractant is recycled from the sulfone-containing waste solvent, and the recycled extractant is put into the step of countercurrent extraction for gasoline or diesel, and the recycled extractant is able to extract and separate the sulfoxide and sulfone in gasoline or diesel conveyed subsequently, so as to achieve the recycling of the extractant, which further saves costs and enhances environmental protection.

In some embodiments, the recycling an extractant comprises the following steps: dehydrating the sulfone-containing waste solvent at 110 to 130° C. and 8 to 12 kPaA to obtain circulating water; recycling solvent from the dehydrated sulfone-containing waste solvent at 90 to 120° C. and 1 to 5 kPaA to obtain circulating solvent; and mixing the circulating water with the circulating solvent to obtain the extractant, wherein the extractant is conveyed into a step of countercurrent extraction for the gasoline or diesel.

In the above technical solutions, the sulfone-containing waste solvent is distilled firstly under negative pressure to dehydrate the sulfone-containing waste solvent and obtain the circulating water; since the boiling point of the extractant is higher than that of water, the dehydrated sulfone-containing waste solvent is then distilled under negative pressure at 90 to 120° C. and 1 to 5 kPaA to obtain the circulating solvent. The circulating water and circulating solvent are mixed to obtain the extractant, and then the extractant is used to extract and separate the sulfoxide or sulfone in the gasoline or diesel, to achieve the recycling of the extractant, which further saves costs and enhances environmental protection.

In some embodiments, in Step 2, mixing the mixture solvent with the gasoline or diesel and heating to 50 to 60° C., and performing the ultrasonic oxidative reaction under ultrasonic waves at 15 to 25 kHz to obtain the pre-prepared oil.

In some embodiments, in Step 2, mixing the mixture solution with gasoline or diesel and heating to 60 to 70° C., and performing an ultrasonic oxidative reaction under ultrasonic waves at 15 to 25 kHz to obtain the pre-prepared oil.

In a second aspect, the present application provides an ultrasonic oxidative desulfurization system for gasoline or diesel adopting the following technical solutions.

The ultrasonic oxidative desulfurization system for gasoline or diesel includes a pipeline mixer configured for conveying and mixing the oxidant and the organic acid catalyst, a gasoline or diesel heater configured for heating the gasoline or diesel, an ultrasonic reactor configured for performing oxidative reaction, a phase separation tank configured for performing a phase separation for the pre-prepared oil, and an extraction tower configured for countercurrent extraction for gasoline or diesel containing the sulfone and sulfoxide, sequentially connected. A inlet of the pipeline mixer is provided with an oxidant pump and a catalyst pump, and an outlet of the pipeline mixer is provided with a gasoline or diesel feed pump. The ultrasonic reactor is in communication with the pipeline mixer by pipelines, the phase separation tank is in communication with the ultrasonic reactor by pipelines, and the extraction tower is in communication with the phase separation tank by pipelines.

In the above technical solutions, the flow rate of the oxidant solution, the organic acid catalyst solution, and the gasoline or diesel are precisely controlled by the oxidant pump, the catalyst pump, and the gasoline or diesel feed pump, respectively, so that the flow rate of the oxidant solution is 3 to 8% of the flow rate of gasoline or diesel, and the flow rate of the organic acid catalyst solution is 1 to 3% of the flow rate of gasoline or diesel. The oxidant solution and the organic acid catalyst solution are firstly conveyed to the pipeline mixer to be mixed and react to generate the peroxy acid, meanwhile the gasoline or diesel is heated by the gasoline or diesel heater, then the peroxy acid and the heated gasoline or diesel are mixed and conveyed to the ultrasonic reactor to perform ultrasonic oxidation reaction, and a phase separation is performed for the organic acid catalyst and the gasoline or diesel by the phase separation tank. After phase separation, the gasoline or diesel is conveyed to the extraction tower for countercurrent extraction.

In some embodiments, the extraction tower has a first outlet and a second inlet located at the top of the extraction tower, and a second outlet and a first inlet located at the bottom of the extraction tower, and the desulfurization system further includes a desolvation tower configured for removing solvents from the desulfurized gasoline or diesel, and the desolvation tower is in communication with the first outlet of the extraction tower by pipelines.

In the above technical solutions, the desulfurized gasoline or diesel is conveyed from the first outlet of the extraction tower to the desolvation tower to remove the small amount of solvent in the desulfurized gasoline or diesel, so as to obtain the desolvated desulfurized gasoline or diesel, which improves the quality of the oil product.

In some embodiments, the desulfurization system further includes a recovery unit configured for recycling the extractant. The recovery unit includes a waste solvent tank, a solvent dehydration tower and a solvent recovery tower. The waste solvent tank is in communication with the second outlet of the extraction tower by pipelines, the solvent dehydration tower is in communication with the waste solvent tank by pipelines, the solvent recovery tower is in communication with the solvent dehydration tower by pipelines, and both the solvent dehydration tower and the solvent recovery tower are in communication with the second inlet of the extraction tower by pipelines.

In the above technical solutions, the sulfone-containing waste solvent is conveyed from the second outlet of the extraction tower to the waste solvent tank, and then the sulfone-containing waste solvent in the waste solvent tank is conveyed to the solvent dehydration tower and the solvent recovery tower to dehydrate and desolventize the sulfone-containing waste solvent, so as to obtain the circulating water and the circulating solvent. And the circulating water and the circulating solvent are mixed and then conveyed to the extraction tower to achieve the recycling of the extractant.

In some embodiments, the solvent recovery tower is in communication with a tail gas combustion system by pipelines, the tail gas combustion system is configured to treat the non-condensable gas in the gasoline or diesel.

In the above technical solutions, a small amount of non-condensable gas in the gasoline or diesel contains methane and other harmful gases or flammable and explosive gases, and the above gases are treated by the tail gas combustion system before emission, so as to ensure the safety of production and reduce the pollution to the environment.

In some embodiments, the bottom of the solvent recovery tower is in communication with an extraction oil desolvation tower by pipelines.

In the above technical solutions, extraction oil is usually recovered at the bottom of the solvent recovery tower, and the extraction oil is conveyed to the extraction oil desolvation tower, so as to extract and remove the residual solvent in the extraction oil. After removing the solvent, the extraction oil can be recovered as a by-product, to enhance the efficiency of industrial production.

In summary, the present application can achieve at least one of the following beneficial effects:

1. The relatively appropriate amount of peroxy acid can oxidize the thiophenic sulfur contained in the gasoline or diesel to sulfone or sulfoxide as completely as possible, enhancing the effect of the oxidative desulfurization of gasoline or diesel, so that the amount of peroxy acid after the ultrasonic oxidation is as little as possible, and reducing the waste of the oxidant and the difficulty for recycling the organic acid catalyst.

2. The aqueous phase of the organic acid catalyst is dried and dehydrated by the desiccant, and the dehydrated organic acid catalyst is re-conveyed into the mixture solution where the peroxy acid is generate, and the organic acid catalyst can react with the oxidant to generate the peroxy acid to achieve the recycling of the organic acid catalyst, which saves costs and enhances environmental protection.

BRIEF DESCRIPTION OF THE DRAWINGS

FIG. 1 is a schematic flow diagram of the desulfurization system according to an embodiment of the present application.

DETAILED DESCRIPTION

The present application is further described in detail below in combination with FIG. 1.

An embodiment of the present application discloses an ultrasonic oxidative desulfurization system for gasoline or diesel. Referring to FIG. 1, the ultrasonic oxidative desulfurization system for gasoline or diesel includes a pipeline mixer 1, a gasoline or diesel heater 21, an ultrasonic reactor 3, a phase separation tank 4, and an extraction tower 5, and the pipeline mixer 1 is provided with an oxidant pump 11 and a catalyst pump 12, and the outlet of the oxidant pump 11 and the outlet of the catalyst pump 12 are both in communication with the inlet of the pipeline mixer 1, the pipeline mixer 1 is configured for conveying and mixing an oxidant and an organic acid catalyst. The outlet of the pipeline mixer 1 is in communication with a gasoline or diesel feed pump 2 by pipelines.

The pipeline mixer 1 is in communication with the inlet of the ultrasonic reactor 3 by pipelines, and pipelines between the pipeline mixer 1 and the ultrasonic reactor 3 is provided with a gasoline or diesel feed pump 2.

The gasoline or diesel heater 21 is connected to the pipelines between the ultrasonic reactor 3 and the gasoline or diesel feed pump 2, and the gasoline or diesel heater 21 is configured to heat the mixture of gasoline or diesel and peroxy acid to 50 to 70° C. to obtain pre-prepared oil.

The phase separation tank 4 is configured to perform phase separation treatment for the pre-prepared oil, and the phase separation tank 4 is provided with an inlet, a light-phase outlet, and a heavy-phase outlet. The inlet of the phase separation tank 4 is in communication with the outlet of the ultrasonic reactor 3 by pipelines. The heavy-phase outlet of the phase separation tank 4 is in communication with an inlet of a catalyst dehydrator 41 by pipelines, the catalyst dehydrator is filled with a desiccant, and the desiccant in this embodiment of the present application is anhydrous magnesium sulfate in 80 to 100 mesh. An outlet of the catalyst dehydrator 41 is in communication with a catalyst circulation pump 121 by pipelines, and an outlet of the catalyst circulation pump 121 is in communication with an inlet of the catalyst pump 12 by pipelines.

The extraction tower 5 is provided with a first outlet and a second inlet located at the top of the extraction tower 5, and a second outlet and a first inlet located at the bottom of the extraction tower 5. The light-phase outlet of the phase separation tank 4 is in communication with the first inlet of the extraction tower 5 by pipelines. The first outlet of the extraction tower 5 is in communication with a desolvation tower 6 by pipelines, and the desolvation tower 6 is configured to remove solvent from the desulfurized gasoline or diesel.

The desulfurization system further includes a recovery unit 7 for recycling the extractant. The recovery unit includes a waste solvent tank 71, a solvent dehydration tower 72 and a solvent recovery tower 73. The waste solvent tank 71 is in communication with the second outlet of the extraction tower 5 by pipelines. The solvent dehydration tower 72 is provided with an first inlet, a first steam outlet and an first outlet, and the solvent recovery tower 73 is also provided with an second inlet, a second steam outlet and an second outlet. The first inlet of the solvent dehydration tower 72 is in communication with the waste solvent tank 71 by pipelines, the second inlet of the solvent recovery tower 73 is in communication with the first outlet of the solvent dehydration tower 72 by pipelines, and the first steam outlet of the solvent dehydration tower 72 and the second steam outlet of the solvent recovery tower 73 are both in communication with the second inlet of the extraction tower 5 by pipelines.

The bottom of the solvent recovery tower 73 is in communication with an extraction oil desolvation tower 9 by pipelines. The extraction oil is usually recovered at the bottom of the solvent recovery tower 73, and the extraction oil is conveyed to the extraction oil desolvation tower 9, so as to extract and remove the residual solvent in the extraction oil. After removing the solvent, the extraction oil can be recovered as a by-product, to enhance the efficiency of industrial production.

The solvent recovery tower 73 is in communication with a tail gas combustion system 8 by pipelines, the solvent gas in the vacuum system will be dissolved in water, the small amount of non-condensable gas in the gasoline or diesel is not easy to be dissolved in water, and the non-condensable gas contains methane and other harmful gases or flammable and explosive gases. The above gases are treated by the tail gas combustion system 8 before emission, so as to ensure the safety of production and reduce the pollution to the environment.

1. EXAMPLE

Examples 1 to 7 relate to ultrasonic oxidative desulfurization for diesel.

Example 1

The ultrasonic oxidative desulfurization method for diesel in this Example is as follows.

The hydrogen peroxide solution (with a mass fraction of 30%) was conveyed to the pipeline mixer 1 through the oxidant pump, at the same time, the formic acid catalyst solution (with a mass fraction of 85%) was conveyed to the pipeline mixer 1 through the catalyst pump, and the diesel was conveyed to the pipeline of the desulfurization system through the gasoline or diesel feed pump 2. In particular, the flow rate of the diesel was 60 kg/h, the flow rate of the hydrogen peroxide solution was 1.8 kg/h, and the flow rate of the formic acid catalyst solution was 0.6 kg/h.

The hydrogen peroxide solution and the formic acid catalyst solution reacted to generate peroxy acid, the peroxy acid and the diesel were mixed and then heated to 55° C. by the gasoline or diesel heater 21, and then the peroxy acid and the diesel were conveyed to the ultrasonic reactor 3. The ultrasonic frequency in the ultrasonic reactor 3 was 20 kHz. The peroxy acid and the diesel were ultrasonic oxidized to produce the pre-prepared oil and the aqueous phase containing the organic acid catalyst.

The pre-prepared oil and the aqueous phase containing the organic acid catalyst were conveyed to the phase separation tank 4 for phase separation treatment. The aqueous phase containing the organic acid catalyst was conveyed to the catalyst dehydrator 41 to be dried and dehydrated by anhydrous magnesium sulfate in 100 mesh, and the dehydrated organic acid catalyst was conveyed to the feed pipeline of the catalyst by the catalyst circulation pump 121, so as to achieve the recycling.

The magnesium sulfate saturated with water was placed in saturated steam at 180° C. and 1 MPa, and the magnesium sulfate was heated to 160° C. for being dried and dehydrated to obtain anhydrous magnesium sulfate, and the anhydrous magnesium sulfate was re-conveyed to the aqueous phase containing the organic acid catalyst, so as to achieve the recycling of the anhydrous magnesium sulfate.

The extractant was a NMP aqueous solution, and the extractant entered into the extraction tower 5 through the second inlet at the top of the extraction tower 5, and the diesel containing sulfone and sulfoxide entered into the extraction tower 5 through the first inlet at the bottom of the extraction tower 5 to perform the countercurrent extraction to the diesel containing sulfone and sulfoxide, so as to obtain desulfurized diesel. The desulfurized diesel was then conveyed to the desolvation tower 6 with a temperature of 100° C. and a pressure of 1 kPaA for desolvation to obtain the desolvated desulfurized diesel.

The sulfone-containing waste solvent which was conveyed out of the second outlet of the extraction tower 5 was conveyed to the waste solvent tank 71, and then conveyed to the solvent dehydration tower 72 for being dehydrated so as to obtain the circulating water. The solvent dehydration tower 72 had a temperature of 120° C. and a pressure of 10 kPaA. The dehydrated sulfone-containing waste solvent was conveyed to the solvent recovery tower 73 to obtain the circulating solvent. The solvent recovery tower 73 had a temperature of 110° C. and a pressure of 3 kPaA. The circulating water and the circulating solvent were mixed to from the extractant, then the extractant was conveyed to the solvent recovery tower 73 and heat exchanged to 70° C. with the solvent steam, and then the extractant was re-conveyed to the extraction tower 5, so as to achieve the recycling of the extractant.

The non-condensable gas generated in the solvent recovery tower 73 was conveyed to the tail gas combustion system 8 for the tail gas treatment; and the extraction oil recovered from the bottom of the solvent recovery tower 73 was conveyed to the extraction oil desolvation tower 9 having a temperature of 130° C. and a pressure of 1 kPaA, so as to obtain the extraction oil as a by-product.

Example 2

The ultrasonic oxidative desulfurization method for diesel of this example differs from Example 1 in that the flow rate of the hydrogen peroxide solution was 3 kg/h and the flow rate of the formic acid catalyst solution was 1.2 kg/h.

Example 3

The ultrasonic oxidative desulfurization method for diesel of this example differs from Example 1 in that the flow rate of the hydrogen peroxide solution was 4.8 kg/h and the flow rate of the formic acid catalyst solution was 1.8 kg/h.

Example 4

The ultrasonic oxidative desulfurization method for diesel of this example differs form Example 2 in that the temperature was 110° C. and the pressure was 8 kPaA in the solvent dehydration tower 72.

Example 5

The ultrasonic oxidative desulfurization method for diesel of this example differs form Example 2 in that the temperature was 130° C. and the pressure was 12 kPaA in the solvent dehydration tower 72.

Example 6

The ultrasonic oxidative desulfurization method for diesel of this example differs from Example 2 in that the temperature was 90° C. and the pressure was 1 kPaA in the solvent recovery tower 73.

Example 7

The ultrasonic oxidative desulfurization method for diesel of this example differs from Example 2 in that the temperature was 120° C. and the pressure was 5 kPaA in the solvent recovery tower 73.

Example 8 to 14 relate to ultrasonic oxidative desulfurization for gasoline.

Example 8

The ultrasonic oxidative desulfurization method for gasoline in this Example is as follows.

The hydrogen peroxide solution (with a mass fraction of 30%) was conveyed to the pipeline mixer 1 through the oxidant pump, at the same time, the formic acid catalyst solution (with a mass fraction of 85%) was conveyed to the pipeline mixer 1 through the catalyst pump, and the gasoline was conveyed to the pipeline of the desulfurization system through the gasoline or diesel feed pump 2. In particular, the flow rate of the gasoline was 60 kg/h, the flow rate of the hydrogen peroxide solution was 1.8 kg/h, and the flow rate of the formic acid catalyst solution was 0.6 kg/h.

The hydrogen peroxide solution and the formic acid catalyst solution reacted to generate peroxy acid, the peroxy acid and the gasoline were mixed and then heated to 55° C. by the gasoline or diesel heater 21, and then the peroxy acid and the gasoline were conveyed to the ultrasonic reactor 3. The ultrasonic frequency in the ultrasonic reactor 3 was 20 kHz. The peroxy acid and the gasoline were ultrasonic oxidized to produce the pre-prepared oil and the aqueous phase containing the organic acid catalyst.

The pre-prepared oil and the aqueous phase containing the organic acid catalyst were conveyed to the phase separation tank 4 for phase separation treatment. The aqueous phase containing the organic acid catalyst was conveyed to the catalyst dehydrator 41 to be dried and dehydrated by anhydrous magnesium sulfate in 100 mesh, and the dehydrated organic acid catalyst was conveyed to the feed pipeline of the catalyst by the catalyst circulation pump 121, so as to achieve the recycling.

The magnesium sulfate saturated with water was placed in saturated steam at 180° C. and 1 MPa, and the magnesium sulfate was heated to 160° C. for being dried and dehydrated to obtain anhydrous magnesium sulfate, and the anhydrous magnesium sulfate was re-conveyed to the aqueous phase containing the organic acid catalyst, so as to achieve the recycling of the anhydrous magnesium sulfate.

The extractant was a NMP aqueous solution, and the extractant entered into the extraction tower 5 through the second inlet at the top of the extraction tower 5, and the gasoline containing sulfone and sulfoxide entered into the extraction tower 5 through the first inlet at the bottom of the extraction tower 5 to perform the countercurrent extraction to the gasoline containing sulfone and sulfoxide, so as to obtain desulfurized gasoline. The desulfurized gasoline was then conveyed to the desolvation tower 6 with a temperature of 100° C. and a pressure of 1 kPaA for desolvation to obtain the desolvated desulfurized gasoline.

The sulfone-containing waste solvent which was conveyed out of the second outlet of the extraction tower 5 was conveyed to the waste solvent tank 71, and then conveyed to the solvent dehydration tower 72 for being dehydrated so as to obtain the circulating water. The solvent dehydration tower 72 had a temperature of 120° C. and a pressure of 10 kPaA. The dehydrated sulfone-containing waste solvent was conveyed to the solvent recovery tower 73 to obtain the circulating solvent. The solvent recovery tower 73 had a temperature of 110° C. and a pressure of 3 kPaA. The circulating water and the circulating solvent were mixed to from the extractant, then the extractant was conveyed to the solvent recovery tower 73 and heat exchanged to 70° C. with the solvent steam, and then the extractant was re-conveyed to the extraction tower 5, so as to achieve the recycling of the extractant.

Example 9

The ultrasonic oxidative desulfurization method for gasoline of this example differs from Example 8 in that the flow rate of the hydrogen peroxide solution was 3 kg/h and the flow rate of the formic acid catalyst solution was 1.2 kg/h.

Example 10

The ultrasonic oxidative desulfurization method for gasoline of this example differs from Example 8 in that the flow rate of the hydrogen peroxide solution was 4.8 kg/h and the flow rate of the formic acid catalyst solution was 1.8 kg/h.

Example 11

The ultrasonic oxidative desulfurization method for gasoline of this example differs form Example 9 in that the temperature was 110° C. and the pressure was 8 kPaA in the solvent dehydration tower 72.

Example 12

The ultrasonic oxidative desulfurization method for gasoline of this example differs form Example 9 in that the temperature was 130° C. and the pressure was 12 kPaA in the solvent dehydration tower 72.

Example 13

The ultrasonic oxidative desulfurization method for gasoline of this example differs from Example 9 in that the temperature was 90° C. and the pressure was 1 kPaA in the solvent recovery tower 73.

Example 14

The ultrasonic oxidative desulfurization method for gasoline of this example differs from Example 9 in that the temperature was 120° C. and the pressure was 5 kPaA in the solvent recovery tower 73.

2. PERFORMANCE TESTING (1) The desolvated desulfurized diesel prepared in accordance with the preparation method in Examples 1 to 7 and the desolvated desulfurized gasoline prepared in accordance with the preparation method in Examples 8 to 14 were tested in accordance with the "GB/T11140-2008 Standard test method for sulfur in petroleum products by wavelength dispersive X-ray fluorescence spectrometry", and the sulfur content of the desolvated desulfurized diesel and the desolvated desulfurized gasoline were tested respectively, and the sulfur content was measured in ppm (parts per million).

(2) Equal amounts of aqueous phase containing the organic acid catalyst were collected at the heavy-phase outlet of the phase separation tanks of the desolvated desulfurized diesel in Examples 1 to 7 and the desolvated desulfurized gasoline in Examples 8 to 14 respectively, and then the content of the peroxy acid in the aqueous phase containing the organic acid catalyst was determined by the iodometry.

The results of the above performance tests are shown in Table 1 and Table 2.

TABLE 1

The results of the performance test of the desolvated desulfurized diesel in Examples 1 to 7

| Test items | The sulfur content of the desolvated desulfurized diesel (ppm) | The content of peroxy acid in aqueous phase containing the organic acid catalyst (%) |
|---|---|---|
| Example 1 | 12 | 0.29 |
| Example 2 | 6 | 0.83 |
| Example 3 | 6 | 2.30 |
| Example 4 | 8 | 0.85 |
| Example 5 | 7 | 0.84 |
| Example 6 | 9 | 0.82 |
| Example 7 | 8 | 0.9 |

TABLE 2

The results of the performance test of the desolvated desulfurized gasoline in Examples 8 to 14

| Test items | The sulfur content of the desolvated desulfurized gasoline (ppm) | The content of peroxy acid in aqueous phase containing the organic acid catalyst (%) |
|---|---|---|
| Example 8 | 11 | 0.32 |
| Example 9 | 5 | 0.76 |
| Example 10 | 5 | 2.55 |
| Example 11 | 7 | 0.82 |
| Example 12 | 7 | 0.79 |
| Example 13 | 9 | 0.82 |
| Example 14 | 8 | 0.84 |

3. ANALYSIS AND SUMMARY OF RESULTS

Combining Examples 1 to 14 with Table 1 and Table 2, it can be seen that the sulfur content of the desolvated desulfurized diesel prepared in Example 1 and the desolvated desulfurized gasoline prepared in Example 8 were 12 ppm and 11 ppm, respectively, the sulfur content of the desolvated desulfurized diesel prepared in Examples 2 and 3 were 6 ppm and 6 ppm, respectively, and the sulfur content of the desolvated desulfurized gasoline prepared in Example 9 and Example 10 were 5 ppm and 5 ppm, respectively. And it can be known from the above that the sulfur content of the desolvated desulfurized diesel obtained in Example 2 and Example 3 was much lower than that of Example 1, and the sulfur content of the desolvated desulfurized gasoline obtained in Example 9 and Example 10 was much lower than that of Example 8.

The contents of peroxy acid in the aqueous phase containing the organic acid catalyst in the process of preparing the desolvated desulfurized diesel in Examples 3 and the desolvated desulfurized gasoline in Example 10 were 2.3% and 2.55%, respectively, and the contents of peroxy acid in the aqueous phase containing the organic acid catalyst in the process of preparing the desolvated desulfurized diesel in Example 2 and the desolvated desulfurized gasoline in Example 9 were 0.83% and 0.76%, respectively.

It can be known from the above that the content of peroxy acid generated in the process of preparing the desolvated desulfurized diesel in Example 3 was higher than that of Example 2, and the content of peroxy acid generated in the process of preparing the desolvated desulfurized gasoline in Example 10 was higher than that of Example 9. Therefore, although Examples 2 to 3 and Examples 9 to 10 all reduced the sulfur content in the desolvated desulfurized diesel and the desolvated desulfurized gasoline, a greater amount of peroxy acid remained in both Examples 3 and Example 10, that is to say, the wasted oxidant is more, and difficulty of recycling the organic acid catalyst in both Example 3 and Example 10 was increased.

In summary, the mass flow ratios of the oxidant solution, the organic acid catalyst solution and the gasoline or diesel in Example 2 and Example 9 can enhance the effect of oxidative desulfurization of the gasoline or diesel, while reducing the degree of waste of the oxidant and the difficulty of recycling the organic acid catalyst.

The temperature parameters and pressure parameters in the solvent dehydration tower and the temperature parameters and pressure parameters in the solvent recovery tower in Examples 4 to 7 were different from those in Example 2, and the temperature parameters and pressure parameters in the solvent dehydration tower and the temperature parameters and pressure parameters in the solvent recovery tower in Examples 11 to 14 were different from those in Example 9. It can be known from Table 1, the sulfur contents in the desolvated desulfurized diesel and the desolvated desulfurized gasoline prepared in Examples 4 to 7 were all higher than that of Example 2, and the sulfur contents in the desolvated desulfurized diesel and the desolvated desulfurized gasoline prepared in Examples 11 to 14 were all higher than that of Example 9. Therefore, the desulfurization effect on the gasoline or diesel in Examples 4 to 7 was worse than that of Example 2, and the desulfurization effect on the gasoline or diesel in Examples 11 to 14 was worse than that of Example 9.

It can be known from the above that, in Example 2 and Example 9, the temperature parameters were both 120° C. and the pressure parameters were both 10 kPaA in the solvent dehydration tower, and the temperature parameters were both 110° C. and the pressure parameters were both 3 kPaA in the solvent dehydration tower. The above parameters can make the extractant in the sulfone-containing waste solvent be more efficiently recycled back to the extraction tower, so as to make the content of the extractant be sufficient in the extractor tower, and to extract and separate the sulfone in the gasoline or diesel conveyed to the extraction tower more sufficiently and thoroughly, which enhances the desulfurization effect of the gasoline or diesel.

The above are the preferred embodiments of the present application, which are not intended to limit the protection scope of the present application. Therefore, all equivalent changes made according to the structure, shape and principle of the present application should be covered within the protection scope of the present application.

LISTING OF REFERENCE SIGNS

1. pipeline mixer;
11. oxidant pump;
12. catalyst pump;
121. catalyst circulation pump;
2. gasoline or diesel feed pump;
21. gasoline or diesel heater;
3. ultrasonic reactor;
4. phase separation tank;
41. catalyst dehydrator;
5. extraction tower;

6. desolvation tower;
7. recovery unit;
71. waste solvent tank;
72. solvent dehydration tower;
73. solvent recovery tower;
8. tail gas combustion system;
9. extraction oil desolvation tower.

What is claimed is:

1. An ultrasonic oxidative desulfurization method for gasoline or diesel, comprising:

Step 1, mixing an oxidant solution with an organic acid catalyst solution to obtain a mixture solution, wherein an oxidant of the oxidant solution reacts with an organic acid catalyst of the organic acid catalyst solution to obtain a peroxy acid;

Step 2, mixing the mixture solution with the gasoline or the diesel and heating to 50 to 70° C., and performing an ultrasonic oxidative reaction under ultrasonic waves at 20 to 25 kHz to obtain a pre-prepared oil; wherein a mass flow ratio of the oxidant solution, the organic acid catalyst solution and the gasoline or the diesel is (0.03-0.08):(0.01-0.03):1;

Step 3, performing a phase separation process to the pre-prepared oil, wherein an upper layer is gasoline or diesel containing sulfone and sulfoxide, and a lower layer is an aqueous phase containing the organic acid catalyst; and Step 4, recycling the organic acid catalyst and performing a countercurrent extraction for the gasoline or the diesel to obtain a desulfurized gasoline or a desulfurized diesel;

wherein a method for recycling the organic acid catalyst comprises:

drying and dehydrating the aqueous phase containing the organic acid catalyst by a desiccant to obtain a dehydrated organic acid catalyst, and formulating the dehydrated organic acid catalyst into a solution and conveying the solution into the mixture solution in the Step 1.

2. The ultrasonic oxidative desulfurization method for gasoline or diesel according to claim 1, wherein the desiccant is passed through a saturated steam at 170 to 190° C. and 0.5 to 2 MPa, and the desiccant is heated to 150 to 170° C. for the drying and dehydrating, and a dehydrated desiccant is conveyed into the aqueous phase containing the organic acid catalyst.

3. The ultrasonic oxidative desulfurization method for gasoline or diesel according to claim 1, further comprising a post-treatment step for the desulfurized gasoline or the desulfurized diesel:

performing a desolvent treatment for the desulfurized gasoline or the desulfurized diesel at a condition of 90 to 110° C. and 0.5 to 1.5 kPa, to obtain a desolvated and desulfurized gasoline or a desolvated and desulfurized diesel.

4. The ultrasonic oxidative desulfurization method for gasoline or diesel according to claim 1, further comprising a step of recycling an extractant from a sulfone-containing waste solvent generated from the countercurrent extraction.

5. The ultrasonic oxidative desulfurization method for gasoline or diesel according to claim 4, wherein the recycling an extractant comprises the following steps:

dehydrating the sulfone-containing waste solvent at 110 to 130° C. and 8 to 12 kPaA to obtain circulating water and a dehydrated sulfone-containing waste solvent; recycling solvent from the dehydrated sulfone-containing waste solvent at 90 to 120° C. and 1 to 5 kPaA to obtain circulating solvent; and mixing the circulating water with the circulating solvent to obtain the extractant, wherein the extractant is conveyed into a step of the countercurrent extraction for the gasoline or the diesel.

* * * * *